United States Patent [19]

Fox et al.

[11] 3,937,438

[45] Feb. 10, 1976

[54] FLEXIBLE MOLD WITH HINGED SLITS

[75] Inventors: Robert H. Fox, Hoffman Estates; Robert J. Henning, Crystal Lake; Robert F. Morgan, Jr., Winnetka, all of Ill.

[73] Assignee: The Quaker Oats Company, Chicago, Ill.

[22] Filed: Dec. 4, 1974

[21] Appl. No.: 529,333

[52] U.S. Cl. ..... 249/117; 249/127; 264/313; 425/440; 425/DIG. 44

[51] Int. Cl.[2] ..... B28B 7/06; B28B 7/20

[58] Field of Search .... 425/803, 440, 441, DIG. 57, 425/DIG. 58, DIG. 44; 264/313, 314, 334, 335, 336, 219, DIG. 50; 249/82, 66 R, 66 A, 127, 183, 134, 179; 164/228

[56] References Cited

UNITED STATES PATENTS

| | | | |
|---|---|---|---|
| 1,551,603 | 9/1925 | Melosi | 249/178 |
| 1,942,993 | 1/1934 | Aultman | 264/DIG. 50 |
| 1,983,602 | 12/1934 | Daubenmeyer | 264/DIG. 50 |
| 3,776,683 | 12/1973 | Putzer | 425/DIG. 44 |

*Primary Examiner*—Francis S. Husar
*Assistant Examiner*—John S. Brown
*Attorney, Agent, or Firm*—J. P. O'Halloran

[57] ABSTRACT

A flexible, distensible mold for use in fabricating art forms and utilitarian articles, and for use with the aid of air pressure differential enlargement of the shaping cavity, is provided with closeable slits extending from at least a portion of the shaping cavity partly into the mold wall, and cooperating slits extending from the outer wall of the mold into a position which is adjacent to and overlapping the internal slits. With these improved molds a withdrawal bore of the shaping cavity can be greatly enlarged and the side walls can be greatly extended with lower air pressure differentials than would be otherwise necessary. This invention provides a hinging action in the expansion of the side wall which utilizes the flexibility of the mold material to expand the withdrawal bore.

6 Claims, 15 Drawing Figures

FIG. 1
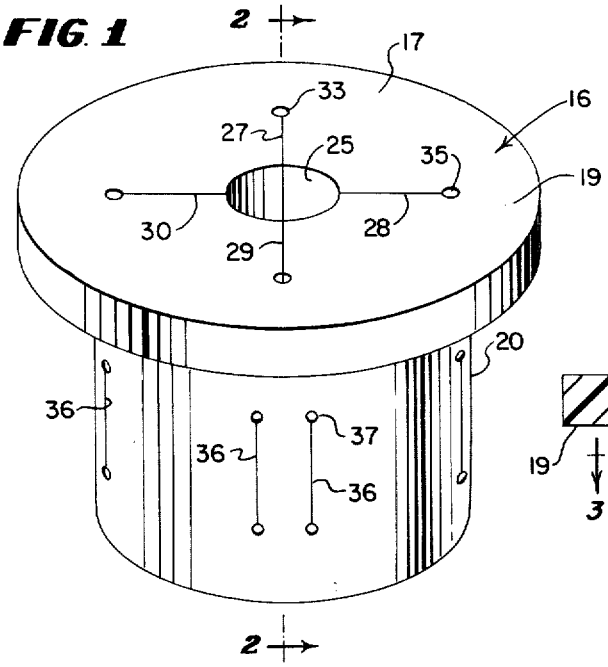
FIG. 2
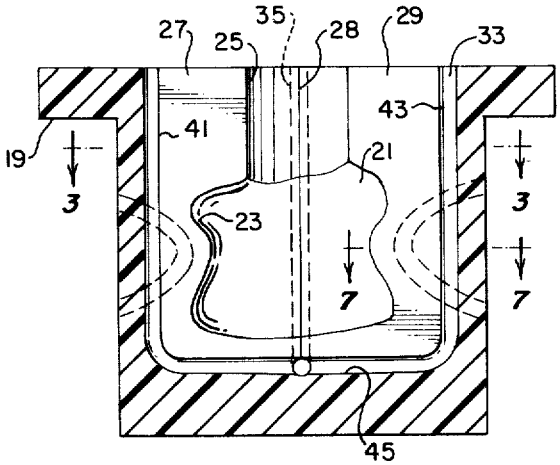
FIG. 3
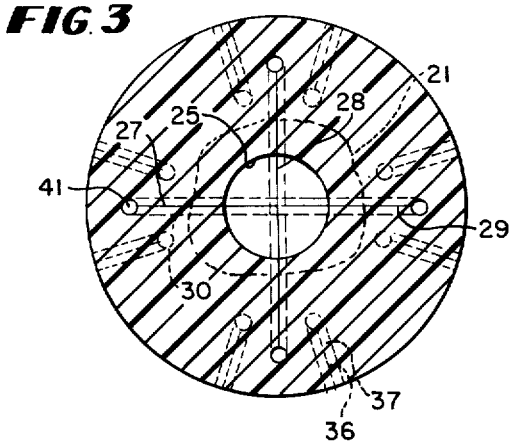
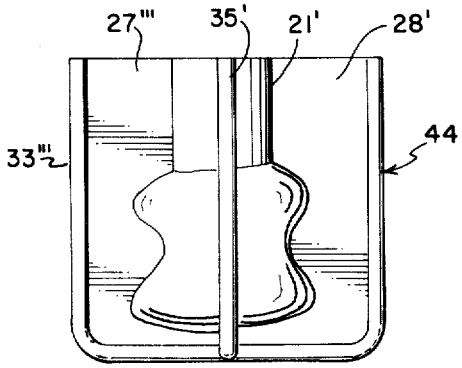
FIG. 4
FIG. 5
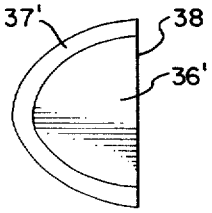
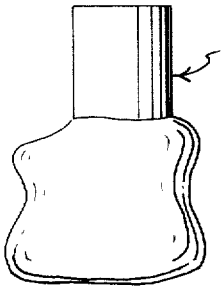
FIG. 6

FIG. 11
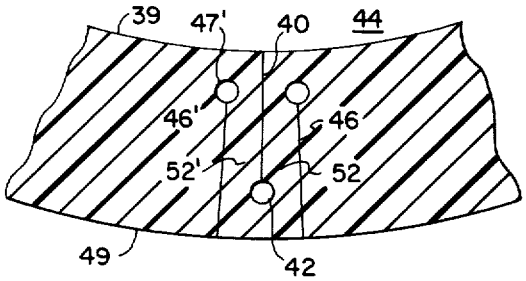
FIG. 12
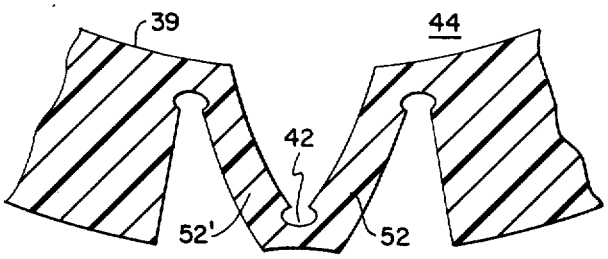
FIG. 13
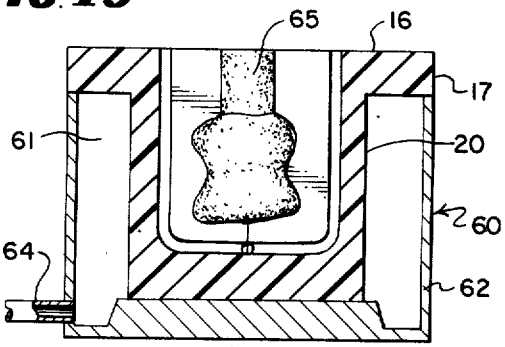
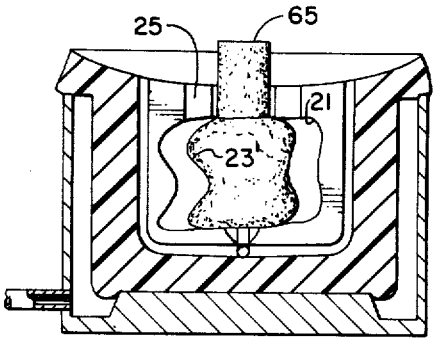
FIG. 14
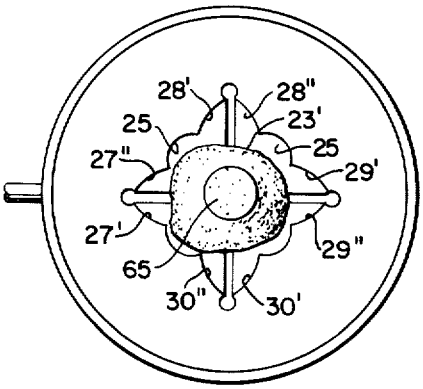
FIG. 15

FLEXIBLE MOLD WITH HINGED SLITS

Flexible, distensible molds can be used to shape art forms as well as utilitarian articles such as hardenable foundry sand mixes for the production of cores and molds. After a hardenable mixture is placed in a shaping cavity and hardens at least to some extent, the shaping cavity of flexible, distensible molds can be enlarged by air pressure differential to such an extent that the shaped article with undercut regions, for example, can be withdrawn from the flexible molds.

Patents relating to such molds include U.S. Pat. No. 2,124,871 C. L. Beal and U.S. Pat. No. 3,776,663 to Putzer.

Continued development in connection with the use of flexible, distensible molds, as such, for example in the production of foundry cores, has uncovered several serious problems. For example, it has been found difficult to faithfully reproduce the dimensions of a pattern when flexible, distensible material is used to make the mold, because the weight of the material being shaped such as, for example, hardenable sand mixes, causes so much distension to the stretchable mold material that the "distension" becomes appreciable "distortion". In many foundry applications, for example, the standards for performance are so strict that the core's dimension must be true within 1/32-inch or less.

One approach taken to stabilize the dimension of the cavity during filling with foundry sand results in molds being made from flexible, distensible material having relatively thick walls. This, in turn, has led to other problems, particularly in connection with removal of the resulting shaped article from the mold by air pressure differential. Many articles have a body portion which is of substantially greater thickness in diameter than that portion of the article which is formed in the neck or filling channel of the mold. These articles are often extremely difficult to withdraw through the relatively small diameter bore of the neck of the mold even after air pressure differential is applied. Inasmuch as the presently contemplated mold for increasing the size of the cavity relies upon the forces generated by an air pressure differential between the exterior and interior of the mold, the vacuum soon becomes an unattractive method for opening or enlarging mold cavities in molds which require very thick walls to stabilize the dimensions of the cavity, if one were to rely only on prior technology.

In accordance with the present invention the flexible, distensible, elastomeric molds are provided with closed, openable slits extending radially outwardly from at least portions of the shaping cavity only partly through the mold wall. In accordance with the present invention cooperating outer slits extending radially inwardly to a position in close proximity to and overlapping with the inner slits are also provided. Thus, provision of slits in accordance with the present invention keeps the walls of the mold impermeable to the passage of air therefrom, and allows the mold to be used as described hereinafter in conjunction with vacuum pots and other air pressure differential means for cavity enlargement for easy removal of the shaped articles therefrom. Instead of relying only upon the distensibility of the elastomeric material from which the mold is made, the present invention enables the flexibility of the material to come into play to provide a hinging action for increasing the withdrawal bore diameter. Thus molds constructed in accordance with this invention particularly molds having relatively thick portions of the walls thereof have been found to allow for relatively easy extraction of patterns and hardenable shaped article such as shaped foundry sand articles, from the mold cavity. The slits, in accordance with the present invention, provide a double hinging action. The slits are "closed" when the material is "at rest", and these slits open wide during the application of pressure differential to provide the mold cavity enlargement far beyond that which is achieved in connection with the mere stretching of the walls by distension of the relatively thick, flexible wall cavity at any given pressure differential. In addition, the slits extending radially inwardly from the outer surface also open during the extension and the relatively thin portion of the wall which is located between the cooperating slits hinges at both slits to allow for an increase in circumference as a consequence of the flexure.

The invention and particularly preferred embodiments thereof are described hereinafter with the aid of the accompanying drawings in which:

FIG. 1 is a perspective view of a mold in accordance with the present invention;

FIG. 2 is a horizontal elevational, cross-sectional view taken along the lines 2—2 of FIG. 1;

FIG. 3 is a cross-sectional view taken approximately along the lines 3—3 of FIG. 2;

FIG. 4 is an elevational side view of a pattern for use in producing molds in accordance with the present invention;

FIG. 5 is a side view of a pattern for use in producing the outer slits of the molds of the embodiment illustrated in FIGS. 1–3;

FIG. 6 is a side view of an article shaped in accordance with the use of the molds of the present invention made with the pattern shown in FIG. 4;

FIGS. 7–12 are fragmentary enlarged, cross-sectional views taken along the lines 7—7 of FIG. 2 illustrating various alternative constructions and the operations of the configuration during expansion of the shaping cavity.

FIG. 7 shows a structure not in accordance with the present claimed invention in which the mold wall has a slit extending partly through the mold wall from the shaping cavity;

FIG. 8 shows the approximate condition of the mold wall of FIG. 7 upon enlargement of the mold cavity as a consequence of air pressure differential;

FIGS. 9–12 illustrate embodiments in accordance with the present invention;

FIG. 9 shows a mold wall having a slit extending partly through the mold wall from the shaping cavity and a second slit extending radially inwardly from the exterior of the mold wall and overlapping the first internal slit;

FIG. 10 shows the configuration of the wall upon expansion of the withdrawal bore by air pressure differential;

FIG. 11 shows an embodiment in which slits extend radially inwardly along either side of the inner slit;

FIG. 12 shows the configuration of the wall upon expansion of the withdrawal bore diameter;

FIGS. 13 and 14 are cross-sectional diagramatic illustrations using a view line along a vertical mid-section plane, of a mold-vacuum box assembly utilizing the mold shown in FIG. 1; and FIG. 14 is the assembly shown in FIG. 10 showing the relative position of elements of the mold as shown in FIG. 13 after vacuum is applied.

FIG. 15 is a top view of the assembly illustrated in FIG. 14.

Figure 7:
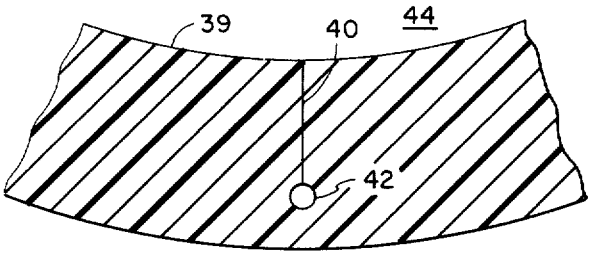

In the accompanying drawings a flexible, distensible mold in accordance with the present invention is generally indicated by the numeral 16. Mold 16 is made of a flexible, distensible, elastomeric material and is of integral construction. Much literature and numerous patents describing the manufacture of flexible molds from elastomeric material, and a particular material used does not constitute part of the invention and is not discussed herein for that reason. Mold 16 includes a top portion 17 including a radially extending flange portion 19. A shaping cavity 21 includes a relatively wide body portion 23 and a relatively narrow neck portion 25 which extends upwardly through top 17. Mold 16 also includes a plurality of slits 27, 28, 29 and 30 which extend between shaping cavity 21 and respective enlarged marginal channels 33, 35. Rounded enlarged slit channels 33, 35, 42, 46, 46' increase the working life of the molds, by assisting in the arresting of slit propagation.

Respective walls 27', 27'', 28', 28'', 29', 29'' and 30', 30'' of slits 27, 28, 29 and 30 abut against one another when the mold is "at rest" as shown in FIG. 1. It is noted the cross-section along the line 2—2 of FIG. 1 extends through slits 27, 29 which extend to marginal channel 33 and at respective slits 28, 30 extends to marginal channel 35. It will be apparent from a consideration of FIG. 5 that the marginal channel 33, 35 extend downwardly through vertical legs 41, 43 and transversely through horizontal portion 45. Channel 35 is similarly constructive. Thus the slits, 27, 28, 29 and 30 extend generally radially outwardly of the shaping cavity 21 to the vertical legs, e.g. 41, 43 of the channels 33, 35 and generally axially downwardly from the cavity to the horizontal portions e.g. 25 of channels 33, 35. The portions of slits 27, 28, 29 and 30 which extend from the bottom of cavity 21 can be viewed in FIG. 3 through shaping cavity opening 25. It is noted that when the mold is in its "at rest" configuration, slits 27, 28, 29 and 30 are "closed". That is, the walls thereof abut each other and the hardenable material being shaped does not enter slits 27, 28, 29 and 30.

Mold 16, in accordance with the present invention, also includes a pair of slits 36 on either side of each of the respective inner slits 27, 28, 29 and 30, and each of the respective outer slits 36 are substantially identical and, consequently, only one slit will be described in detail, and specific numeral reference to the slits 36 side walls, etc. will not be made for the purpose of simplifying the description. Slit 36 extends only partly through the wall of the mold 16, as shown in FIG. 2 and ends in enlarged marginal channel 37. Thus the construction of slit 36 is similar to the construction of slits 27, 28, 29, and 30, in the preferred embodiment, inasmuch as the termination in an enlarged marginal portion is concerned. It will be appreciated from a consideration of FIG. 3, for example, that slits 36 extend radially inwardly along side inner slits 27, 28, 29, and 30, and slits 36 and marginal portions 37 extend only partly part way through the wall of the mold 16. The cooperation of slits 36 with inner slits 27, 28, 29, and 30 will be discussed in connection with FIGS. 7–12.

A pattern for the use in the fabrication of the mold in accordance with the present invention is illustrated in FIG. 4 and generally indicated by the numeral 44. Pattern 44 includes a body portion 21' which corresponds to the shape of the shaping cavity 21. Pattern 44 includes radially outwardly extending fins, for example, 27''' and 29''' corresponding to slits 27, 28, 29 and 30, the fins extending radially outwardly and axially downwardly to connect with marginally enlarged portions, for example, 33', and 35' corresponding negatively to the shape of channels 33 and 35. The pattern 44 is used to shape the cavity position 21 of mold 16 as illustrated in FIG. 1 in the well known and customary manner by immersing the pattern 44 in a hardenable polymerizable elastomeric liquid material which hardens to provide the pattern 44 embedded in the mold material. Upon the removal of pattern 44 from the solidified mold material, mold 16 results. A pattern 38 for forming slits 36 and marginal portions 37 is illustrated in FIG. 5. Pattern 38 includes a film portion 36' having a partial marginal portion 37' which is enlarged respective to film portion 36.

When the shaping cavity 21 is filled with a hardenable mixture such as, for example, a hardenable foundry sand mixture, a shaped foundry article such as core 45 which is illustrated in FIG. 6 results.

Figure 8:
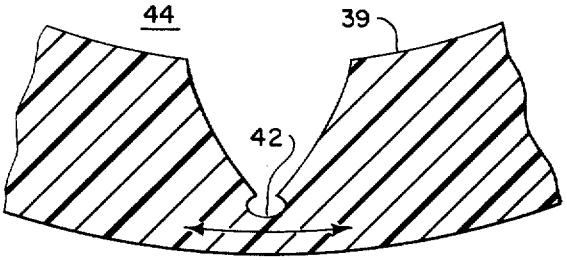

The cooperation of the inner slits 27, 28, 29, and 30 with outer slits 36 is illustrated with the aid of the drawings in FIGS. 7 through 12. The structures of FIGS. 7 and 8 are not in accordance with the present invention but provide a basis for better appreciating the present invention. FIG. 7 shows a portion of a wall 39 of flexible distensible material having a slit 40 extending partly therethrough from shaping cavity 44, which slit 40 terminates radially outwardly in an enlarged portion 42. The change in configuration of wall 39 which takes place as a consequence of the differential pressure expansion of cavity 44 is illustrated with the aid of FIG. 8. It is noted that the slit 40 opens widely whereby the walls of slit 40 contributes in part to the circumferential dimension of cavity 44, and wall 39 is stretched most severely in the region of enlarged portion 42. Thus, although the walls of slit 40 can be regarded as "pivoting" or "hinging" to the open position shown in FIG. 8, it is apparent this result is the consequence of distension of the flexible distensible material from which wall 39 is made. This enlargement of the shaping cavity 44 does not utilize to advantage the inherent flexibility of the material from which wall 39 is made.

Figure 9:
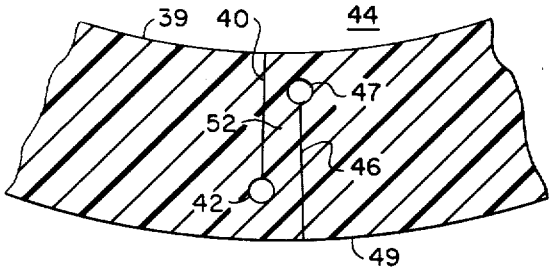
Figure 10:
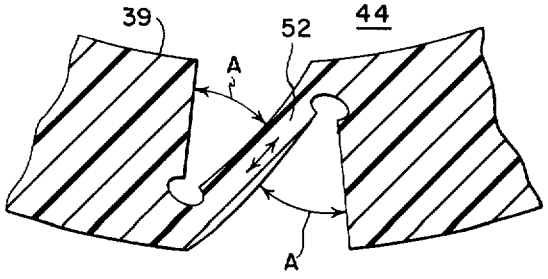

In accordance with the present invention, however, as illustrated in FIGS. 9–12, it will be appreciated that the inherent flexibility of the material from which wall 39 is made is utilized to assist in the increasing of the size of cavity 44 under differential air pressure. As illustrated in FIG. 9, and in accordance with the present invention, a first slit 46 is provided in wall 39, which slit 46 extends from the outer surface 49 of wall 39 partway through wall 39. Slit 46 terminates at its inner extreme in enlarged portions 47. Thus, a strip 52 of flexible distensible material is positioned in wall 39 between overlapping portions of slit 40 and slit 46. FIG. 10 illustrates the change in configuration which occurs as shaping cavity 44 is expanded due to air pressure differential. It will be appreciated as a result of consideration of FIG. 10 that slit 40 can open, as illustrated in FIG. 10 without subjecting wall 39 to substantial distension. Under positive differential pressure in cavity 44 strip 52 pivots away from opposite abutting portions of wall 39 at either side of strip 52 as indicated by the arrows marked A and A' in FIG. 10. In addition, strip 52 and the portions of wall 39 at which strip 52 is attached can undergo some distension, and, indeed, these portions 52 which will be subjected to the greatest deformation upon continued enlargement of the cavity 44.

It is preferred that the thickness of band 52, that is the distance between adjacent closed slits 40, 46 be less than the thickness of the mold wall 39 in the region of the associated inner slit 40. It is also preferred that the thickness of bands 52, 52' be smaller than the length of the band, that is, the length of overlap of slits 40, 46.

It will be appreciated that as a result of consideration of FIGS. 9 and 10 that, in accordance with the present invention, the flexibility of the material from which wall 39 is made is utilized, in conjunction with the distensibility of the material, to facilitate the enlargement of cavity 44 under differential air pressure. A particularly preferred embodiment of the present invention is illustrated with the aid of FIGS. 11 and 12. In FIG. 11 wall 39 has been provided with an additional outer slit 46' extending from the outer surface 49 partly through wall 39 and terminating at the radially inward extreme in an enlarged portion 47'. It is noted that slit 46' is positioned at the opposite side of slit 40 from slit 46. Thus, a second strip 52' is provided at the other side of slit 40. FIG. 12 shows the configuration of wall 39 when shaping cavity 44 is expanded as described hereinbefore. Strips 52, 52' hinge away from each other as well as from adjacent abutting portions of wall 39, to form the V configuration as shown in FIG. 12. Thus, it will be appreciated from consideration of FIGS. 10 and 12 that the cavity 44 and in particular the circumferential dimension of the cavity 44 is greatly increased as a consequence of the flexing of the wall strips 52, 52' rather than as a consequence of sheer distension of the entire wall material.

It will also be appreciated from a consideration of FIGS. 9–12, inclusive, that both the inner slits 40 and the outer slits 46, 46' extend only part way through wall 39 and the chamber 44 is maintained as an air tight compartment due to the positioning of the slits, and due to the fact that these slits, 40, 46, 46' only extend partway through the wall 39. It is appreciated as a consequence of consideration of FIGS. 10 and 12 that strips 52, 52' are relatively thin and stretch relatively easily as compared to the portions of wall 39 having no slits therein. In the preferred embodiment, both bands 52, 52' are thinner than wall 39 with the region between the bands. It is also preferred that the thickness of bands 52, 52' be less than the length of overlap of slits 40 and 46 or of slits 40 and 46'.

Thus, in accordance with the present invention we provide an integral flexible distensible mold having a wall portion defining a shaping cavity therein, the wall of the shaping cavity including a closed openable slit extending from at least a portion of the wall of the shaping cavity and only partly through the wall portion of the mold, and, in addition, the wall portion includes a closed openable slit extending from the outer surface of the mold partly through the mold wall at such a position and to an extent that a relatively thin band 52 of flexible distensible wall material is positioned between the inner and outer slits.

In a particularly preferred embodiment of the present invention outer slits are provided at both sides of the inner slits. The number of inner slits 27, 28, 29, 30 and 40 which are provided is not critical and depend primarily on the degree of undercut of particular structures in the shaping cavity and on the extent to which the shaping cavity must be enlarged to remove the shaped article therefrom. In the embodiment illustrated in FIGS. 1–6, four internal slits 27, 28, 29, and 30 are provided and outer slit 36 are provided only in the regions of an undercut, that is, at the region of a particularly thick portion of the mold 16.

FIGS. 13, 14, and 15 illustrate the cooperation of a mold in accordance with the present invention with a vacuum pot, to cause expansion of shaping cavity 21 as a result of air pressure differential.

In FIG. 13 a mold 16 is shown positioned within vacuum pot 60 to provide an annular air space 61 between body portion 20 and side walls 62 of pot 60. Vacuum pot 60 is equipped with a conduit 64 communicating with space 61, and connected to conventional air pump for withdrawing air from space 61. Flange 17 cooperates with and rests upon wall 62 to provide an annular air seal therebetween. A hardenable foundry sand mix 65 is packed in cavity 21 and allowed to harden. Air is evacuated, at least in part, from air space 61 causing a positive differential air pressure in cavity 21, causing the shaping cavity 21 to enlarge substantially as body portion 20 moves closer to pot wall 62, as illustrated in FIG. 14. Also the mouth 25 is enlarged substantially to allow enlarged portions 23' of the sand shaped 65 to be withdrawn through mouth 25. FIG. 15 is a top view of the configuration shown in FIG. 14 illustrating the nature of the opening of the slits to provide the enlarged mouth 25 for withdrawal of sand shaped article 65.

The illustrated embodiments have been shown for illustrative purposes only and it is to be understood that, given the disclosure herein, many variations and combinations can be made without departing from the spirit and scope of the present invention. For example, an embodiment using four internal slits is illustrated, but one or more internal slits can be utilized and the numbers of slits which are provided can be responsive to the needs of the particular mold cavity. Also, in accordance with the present invention, it is not necessary that slits 27, 28, 29 and 30 extend around the entire periphery of the enlarged body portion 20 but, instead, can extend radially from portions of shaping cavity 21. Thus, for example, slits 27, 28, 29 and 30 could extend from the neck portion 25 radially to a distance approximately at the radially extent of the enlarged body portion of cavity 21, with corresponding outer slits provided in the adjacent portions of the mold body portion 20. In an alternative embodiment, the slits can extend only from the enlarged body portions or from backdrafts at thick wall portions within the body portion and can extend in directions other than in the illustrated axial or radial directions, with corresponding outer slits.

In accordance with the present invention the shaping cavity of a thick walled flexible, distensible mold can be enlarged at lower differential gas pressures, using the inherent flexibility of the mold material, so that greater enlargement can be achieved with less distention of the walls.

In fact, thicker walled molds permit relatively longer length bands 52, 52' and thus provide greater increase in cavity size with fewer inner slits before substantial wall distension is required.

We claim:

1. In an integral, flexible, distensible mold having a body portion including a wall defining a shaping cavity therein, the improvement comprising: a closed, openable first slit to said wall, said first slit extending from at least a portion of the wall from the shaping cavity and only partly through the wall portion of the mold; and a second slit in said wall, said second slit extending from at least a portion of the outer surface of body portion and inwardly only partly through the wall of the mold; said first and second slit defining a strip of flexible, distensible material therebetween, the slits including an enlarged marginal portion thereof at the inner edges thereof.

2. The mold of claim 1 in which said strip is substantially thinner than the thickness of the wall in the region of said first slit.

3. A flexible, distensible mold having a wall defining a shaping cavity; said mold having a first closed, openable slit extending radially outwardly into said wall from said shaping cavity, which first slit extends from the top to the bottom of said cavity, said slit extending only partly through the wall of said mold; said mold also having a second slit, said second slit extending from at least the outer surface of said mold inwardly only partly through said mold; said second slit and said first slit defining therebetween a strip of flexible, distensible wall material, said strip being thinner than the thickness of the wall in the region of said first slit, the slits including enlarged marginal portions thereof at the radial extremes thereof.

4. A flexible, distensible mold having a radially extending flange portion at the top thereof, and having a body portion depending from said flange portion, and a shaping cavity extending through the top portion and into the body portion, said mold having a closed, openable first slit through at least a portion of the mold, said first slit extending from at least a portion of the shaping cavity and only part way through the mold, said mold having a second slit through at least a portion of the mold, said second slit extending from at least a portion of the outer surface of the mold, and inwardly only part way through the mold, said first and second slits defining therebetween a flexible, distensible, integral strip, the slits terminating internally with an enlarged portion thereof.

5. The mold of claim 4 in which said band is thinner than the thickness of the mold wall in the region of the first slit.

6. In an integral, flexible, distensible mold having a body portion including a wall defining a shaping cavity therein, the improvement comprising: a closed, openable first slit to said wall, said first slit extending from at least a portion of the wall from the shaping cavity and only partly through the wall portion of the mold; and a second slit in said wall, said second slit extending from at least a portion of the outer surface of body portion and inwardly only partly through the wall of the mold, said first and second slit defining a strip of flexible, distensible material therebetween and in which mold there is provided two of said second slits on opposite sides of said first slits.

* * * * *